US011199029B2

(12) United States Patent
Manser

(10) Patent No.: US 11,199,029 B2
(45) Date of Patent: Dec. 14, 2021

(54) SECURITY SYSTEM FOR PORTABLE CONSUMER ARTICLE

(71) Applicant: SE-KURE CONTROLS, INC., Franklin Park, IL (US)

(72) Inventor: John Manser, Elgin, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 0 days.

(21) Appl. No.: 16/877,700

(22) Filed: May 19, 2020

(65) Prior Publication Data

US 2020/0370344 A1 Nov. 26, 2020

Related U.S. Application Data

(60) Provisional application No. 62/850,016, filed on May 20, 2019.

(51) Int. Cl.
*E05B 69/00* (2006.01)
*A47F 5/00* (2006.01)

(52) U.S. Cl.
CPC ..... *E05B 69/006* (2013.01); *A47F 5/0006* (2013.01)

(58) Field of Classification Search
CPC .... E05B 69/006; A47F 5/0006; A47F 5/0861; A47F 7/024; A47F 7/285
See application file for complete search history.

(56) References Cited

U.S. PATENT DOCUMENTS 297,822 A * 4/1884 Manahan ..... A47F 5/0006 248/691
635,721 A * 10/1899 Grant ..... A47F 5/0006 248/691
744,819 A * 11/1903 Thomas ..... A47H 13/00 160/330
880,318 A * 2/1908 Mattox ..... E05C 19/10 292/108
1,432,589 A * 10/1922 Brazeau ..... A45C 13/20 211/7
1,856,239 A * 5/1932 Buckley ..... A47F 7/024 211/4
3,921,814 A * 11/1975 Solomon ..... B65G 9/002 211/162
3,993,195 A * 11/1976 Caligiuri ..... E05B 69/006 211/7
4,079,840 A * 3/1978 Usner ..... A47F 7/19 211/124
4,494,896 A * 1/1985 DiFranco ..... B60P 3/00 211/105.3

(Continued)

*Primary Examiner* — Ko H Chan
(74) *Attorney, Agent, or Firm* — Wood, Phillips, Katz, Clark & Mortimer

(57) ABSTRACT

In combination: a) a portable consumer article having a U-shaped portion; and b) a security system having: a frame; and a closure assembly movable to change the security system between a loading state and a secured state. The frame, closure assembly, and portable consumer article are configured so that: i) with the security system in the loading state the U-shaped portion can be displayed to straddle a part of the frame; and ii) with the portable consumer article displayed the security system can be changed from the loading state into the secured state wherein the article is prevented from being separated from the security system.

17 Claims, 4 Drawing Sheets

(56) References Cited

U.S. PATENT DOCUMENTS

| | | | | |
|---|---|---|---|---|
| 4,696,405 | A * | 9/1987 | Waring | F41A 23/18 16/360 |
| 4,811,853 | A * | 3/1989 | Mead | B65D 85/185 206/279 |
| 4,869,376 | A * | 9/1989 | Valiulis | A47F 5/0823 211/59.1 |
| 5,121,844 | A * | 6/1992 | Ball | A47B 61/02 211/105.3 |
| 5,823,358 | A | 10/1998 | Leyden et al. | |
| 6,330,815 | B1 * | 12/2001 | Duncan | B60R 7/14 211/4 |
| 6,926,159 | B1 * | 8/2005 | Cash | B25H 3/04 211/57.1 |
| 6,932,221 | B2 * | 8/2005 | McMurray | A47F 5/0861 211/4 |
| 7,887,146 | B1 * | 2/2011 | Louie | A61J 1/16 312/209 |
| 8,668,177 | B2 * | 3/2014 | Stein | A47G 29/083 248/308 |
| 9,622,596 | B2 * | 4/2017 | Trainor-Smith | A47B 96/021 |
| 2020/0205586 | A1 * | 7/2020 | Arradondo | A47F 3/001 |

* cited by examiner

COMPONENT

SECURITY SYSTEM FOR PORTABLE CONSUMER ARTICLE

BACKGROUND OF THE INVENTION

Field of the Invention

This invention relates to point-of-purchase displays for portable consumer articles and, more particularly, to a security system configured to support a plurality of the portable consumer articles in a hanging, displayed position.

Background Art

Many different types of security systems have been devised for supporting a plurality of portable consumer articles, each in a hanging display position. One such security system is disclosed in U.S. Pat. No. 5,823,358 (the '358 patent).

In the '358 patent, an elongate arm is configured so that a plurality of garment hangers can be hung therefrom in spaced relationship along the length of the arm. An elongate cover is movable to captively overlie the hanger hooks on the arm. A captive force upon the hanger hooks causes them to be squeezed into a compressible layer on the arm, whereby the lengthwise position of each hanger hook is substantially fixed and the hanger hooks are prevented from shifting relative to each other and along the length of the arm.

The particular design depicted in the '358 patent has been commercially successful. However, this design is focused principally on securely fixing the hooked region of the hanger which, if movable relative to the arm, might be disengaged therefrom. By reason of this construction, the arrangement, and appearance, of the garments displayed are established and fixed once the cover is locked in place. Thus, if there is a large number of the garments displayed, it may be difficult for a potential consumer to resituate the garments to allow an appropriate inspection that may be desired before a purchasing decision is made. That is, the adjacent garments may interfere with access and obstruct viewing of the garment of interest.

Further, by reason of having to lift the front portion of the cover away from the arm through a pivoting action, the operator of the system may have to reach to a significant height. This may be inconvenient for relatively tall people and impossible for a shorter person without the use of a step or a ladder.

While the above system has been widely accepted, certain improvements in the basic design would be beneficial.

SUMMARY OF THE INVENTION

The invention is directed to the combination of a portable consumer article, having a U-shaped portion, and a security system. The security system includes: a frame having a top and bottom, a mounting end, an end opposite the mounting end, and laterally spaced sides; and a closure assembly having at least a portion mounted to the frame for guided movement relative to the frame between a loading position, wherein the security system is in a loading state, and a securing position, wherein the security system is in a secured stated. The frame, closure assembly, and portable consumer article are configured so that: i) with the security system in the loading state the U-shaped portion and the frame can be relatively moved to cause the opposite end of the frame to be directed through the U-shaped portion whereupon the portable consumer article assumes a display position wherein the U-shaped portion is inverted and straddles a part of the frame between the mounting and opposite frame ends; and ii) with the portable consumer article in the display position and the security system changed from the loading state into the secured state the frame and closure assembly cooperatively prevent the portable consumer article from being separated from the security system by causing the U-shaped portion to be advanced relative to the security system in a direction from the mounting end of the frame towards the opposite end of the frame. At least a part of the portion of the closure assembly moves in a generally side-to-side path relative to the frame into overlying relationship with the frame, as viewed from the top of the frame, as an incident of the portion of the closure assembly moving from the loading position into the securing position.

In one form, the frame has an elongate shape between the mounting end of the frame and the opposite end of the frame.

In one form, the portion of the closure assembly is pivotable around an axis between the loading and securing positions.

In one form, the axis extends in a vertical direction.

In one form, the frame has a mounting assembly at the mounting end of the frame. An elongate body projects in cantilever fashion from the mounting assembly.

In one form, the elongate body has a central axis and a convexly curved surface against which the U-shaped portion of the portable consumer article bears with the portable consumer article in the display position.

In one form, the portion of the closure assembly defines a receptacle into which a part of the elongate body extends as an incident of the portion of the closure assembly moving from the loading position into the securing position.

In one form, the part of the body has a cylindrical outer surface. The receptacle has a concave surface that is complementary to the outer surface of the part of the body.

In one form, there are cooperating surfaces on the frame and portion of the closure assembly that abut to limit movement of the portion of the closure assembly as the portion of the closure assembly is pivoted from the securing position into the loading position.

In one form, the cooperating surface on the frame is defined by an elongate post.

In one form, the frame has a mounting assembly at the mounting end of the frame. An elongate body projects in cantilever fashion from the mounting assembly. The elongate post projects from the elongate body.

In one form, the post projects in cantilever fashion from the elongate body.

In one form, the portion of the closure assembly consists of an elongate strip with an offset, depending end portion.

In one form, the elongate strip has a flat shape.

In one form, the elongate strip and offset, depending end portion are formed from a sheet of flat stock.

In one form, the flat shape has an edge. There are cooperating surfaces on the frame and portion of the closure assembly that abut to limit movement of the portion of the closure assembly as the portion of the closure assembly is pivoted from the securing position into the loading position. The cooperating surface on the portion of the closure assembly is on the edge of the flat shape.

In one form, the security system further includes a locking assembly that has locked and unlocked states. The locking assembly in the locked state cooperates between the offset, depending end portion and the opposite end of the frame.

In one form, the locking assembly has a cylinder with an element that is projected into a receptacle at the opposite end of the frame with the locking assembly in the locked state.

In one form, the frame has a mounting assembly at the mounting end of the frame. An elongate body projects in cantilever fashion from the mounting assembly. The closure assembly is in the form of an elongate strip. The security system further includes a stepped diameter post with an axis and that guides pivoting movement of the portion of the closure assembly. The elongate strip is supported by the post in spaced relationship with the elongate body along the post axis. A vertical gap is maintained between the elongate strip and the elongate body within which the U-shaped portion of the portable consumer article resides with the portable consumer article in the display position and the security system in the secured state.

In one form, the portable consumer article is a handbag with a strap that defines the U-shaped portion.

DETAILED DESCRIPTION OF THE PREFERRED EMBODIMENT

Figure 1:
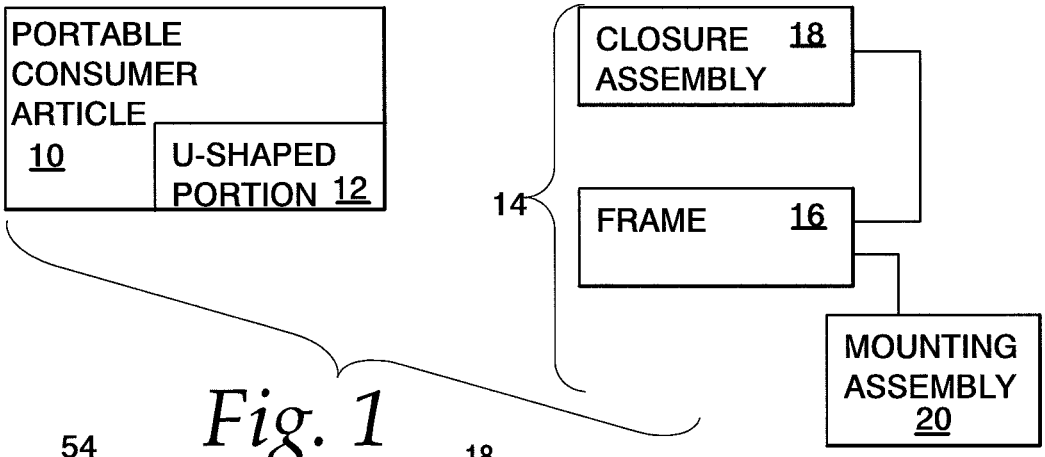
FIG. 1 is a schematic representation of a security system, according to the present invention, in combination with a portable consumer article to be displayed on the security system.

As depicted schematically in FIG. 1, the present invention is directed to the combination of a portable consumer article 10, having a U-shaped portion 12, and a security system 14.

The security system 14 has a frame 16 with a top and bottom, a mounting end, an end opposite the mounting end, and laterally spaced sides. The security system 14 further has a closure assembly 18 having at least a portion mounted for guided movement relative to the frame 16 between a loading position, wherein the security system 14 is in a loading state, and a securing position, wherein the securing system 14 is in a secured state.

The frame 16, closure assembly 18, and portable consumer article 10 are configured so that: a) with the security system 14 in the loading state, the U-shaped portion 12 of the article 10 and the frame 16 can be relatively moved to cause the opposite end of the frame 16 to be directed through the U-shaped portion 12, whereupon the portable consumer article 10 assumes a display position wherein the U-shaped portion 12 is inverted and straddles a part of the frame 16 between the mounting and opposite frame ends; and b) with the portable consumer article 10 in the display position, and the security system 14 changed from the loading state into the secured state, the frame 16 and closure assembly 18 cooperatively prevent the portable consumer article 10 from being separated from the security system 14, as by causing the U-shaped portion 12 to be advanced relative to the security system 14, in a direction from the mounting end of the frame 16 towards the opposite end of the frame 16.

At least a part of the portion of the closure assembly 18 moves in a side-to-side path relative to the frame 16, into overlying relationship with the frame 16, as viewed from the top of the frame, as an incident of the portion of the closure assembly 18 moving from the loading position into the securing position. With the security system in one preferred orientation, with the top and bottom vertically spaced, this path is generally horizontal.

The schematic representation in FIG. 1 is intended to encompass the specific components as described hereinbelow, as well as a multitude of modified forms of those components and their interaction.

As just one example, the part of the portion of the closure assembly that moves side-to-side, horizontally, etc. may do so in translation, by pivoting, etc.

Further, the frame 16 has a mounting assembly 20 through which the frame 16 can be operatively supported in different ways. For example, the frame 16 may be part of a self-contained unit that is maintained in an elevated position by one or more uprights, supported as by a floor or shelf. Alternatively, the mounting assembly 20 may connect to a vertical structure, such as a wall.

A specific form of the invention is described hereinbelow and is exemplary in nature only.

Referring now to FIGS. 2-17, the security system 14 is shown as used to display a portable consumer article 10 in the form of a handbag. The handbag 10 has a case 22 defining a receptacle 24 for discrete personal articles and a cover 26 that can be selectively repositioned to block the receptacle 24 or allow access thereto by way of a top opening 28. A conventional strap 30 defines the inverted, U-shaped portion 12 that can be used as a handle to hold and transport the handbag 10.

As noted above, the invention is not limited to the depicted handbag construction, as any portable consumer article with a U-shaped portion that can be accommodated by the security system 14 is contemplated.

The frame 16 has a top 32, a bottom 34, a mounting end 36, an end 38 opposite the mounting end 36, and laterally spaced sides 40, 42.

In this embodiment, the mounting assembly 20 is configured to clamp to a vertical component 44, as in the form of a square tube. The mounting assembly 20 defines a receptacle 45 that is complementary in shape to the perimeter surface of the component 44. Separate thumbscrews 46 fix the mounting assembly 20 at a desired vertical location on the component 44.

The frame 16 consists of an elongate body 48 that projects in cantilever fashion from the mounting assembly 20. The body 48 has a central axis 50 that in the depicted embodiment extends substantially horizontally with the mounting assembly 20 connected to an appropriate support therefor.

Figure 3:
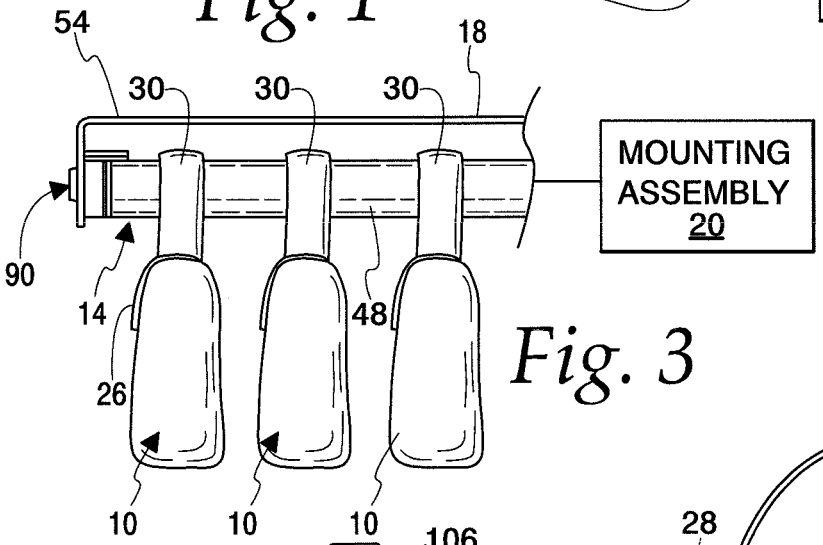
FIG. 3 is a side elevation view of one specific form of the security system in FIG. 1 with a number of handbags, as in FIG. 2, each in a display position thereon.
Figure 2:
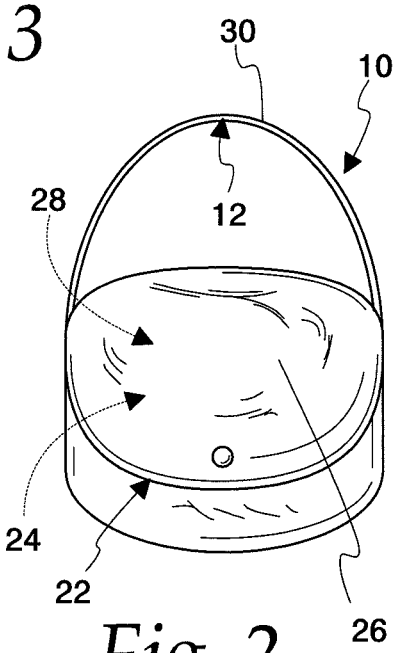
FIG. 2 is a front elevation view of one exemplary form of portable consumer article that can be displayed on the system in FIG. 1 and in the form of a handbag with a carrying strap.
Figure 17:
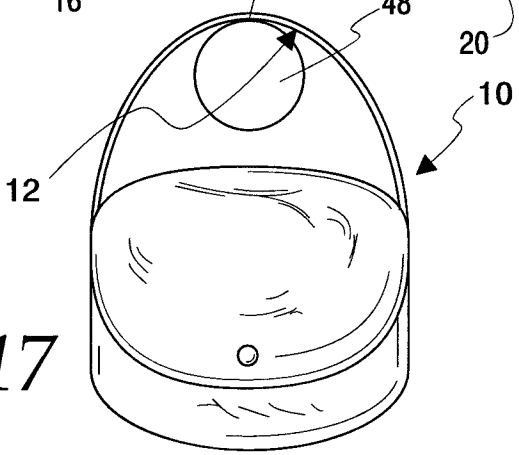
FIG. 17 is a front elevation view of the security system with a handbag, as in FIG. 2, in a display position thereon.
Figure 16:
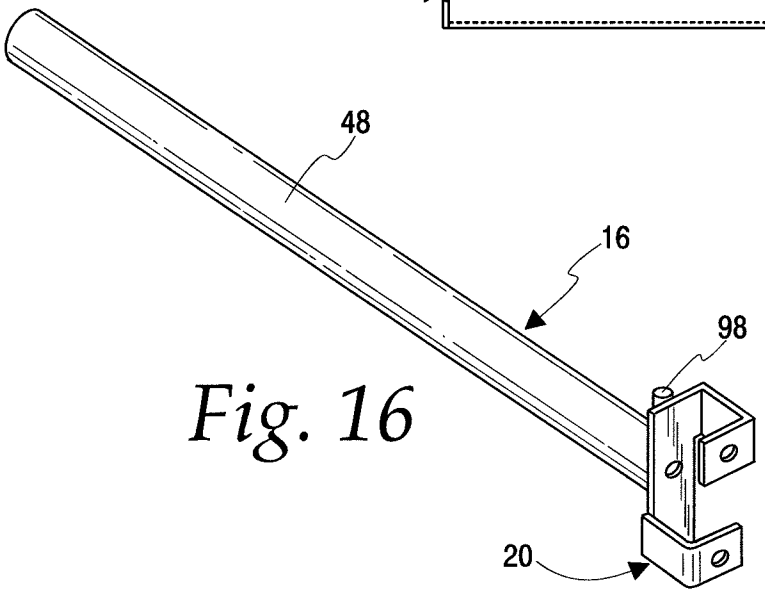
FIG. 16 is a perspective view of the frame in FIGS. 14 and 15.

In this embodiment, the body 48 has a cylindrical cross-sectional configuration. This is not a requirement, however it is desirable that at least the upper half of the body 48 have a convexly curved surface 52 against which the U-shaped portion 12 of the handbag 10 bears with the handbag 10 in a display position, as shown in FIGS. 3 and 17.

Figure 4:
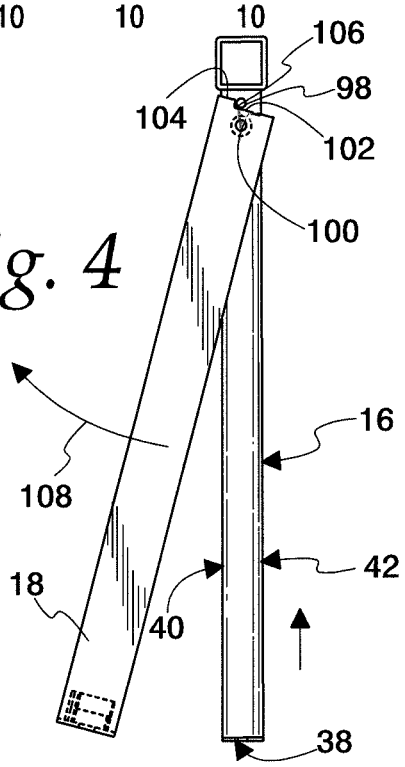
FIG. 4 is a plan view of the security system in FIG. 3 with a closure assembly on the security system positioned relative to a frame to place the security system in a loading state.
Figures 5, 6, 7, 8:
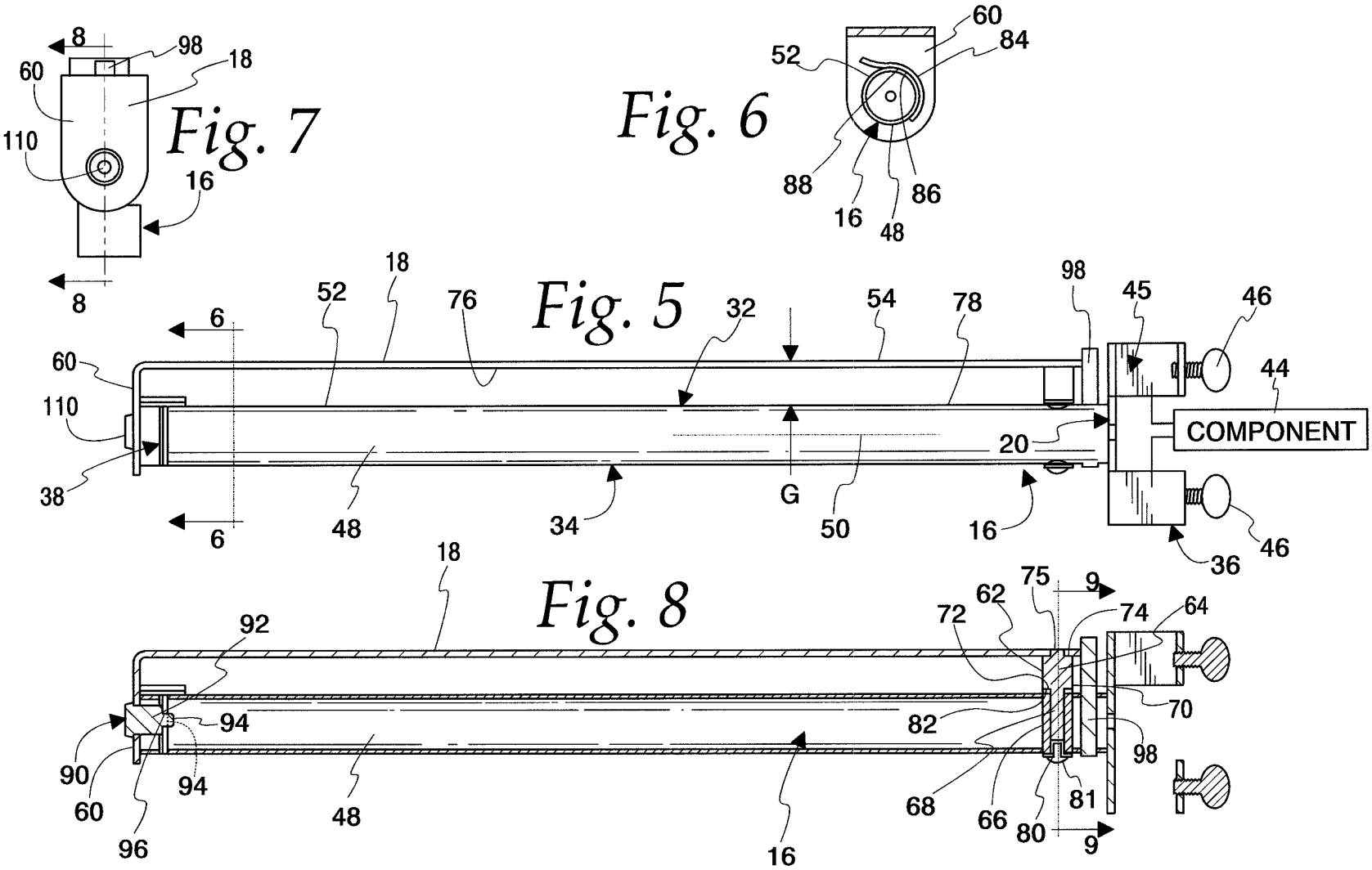
FIG. 5 is a view as in FIG. 3 and showing an exemplary, specific form of mounting assembly on the frame through which the frame is operatively connected for use.
FIG. 6 is a cross-sectional view of the security system taken along line 6-6 of FIG. 5.
FIG. 7 is an end elevation view of the security system.
FIG. 8 is a cross-sectional view of the security system taken along line 8-8 of FIG. 7.
Figure 9:
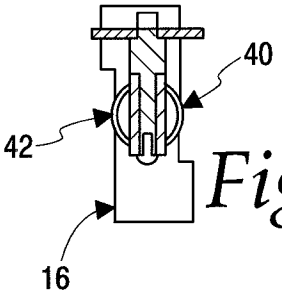
FIG. 9 is a cross-sectional view of the security system taken along line 9-9 of FIG. 8.
Figure 10:
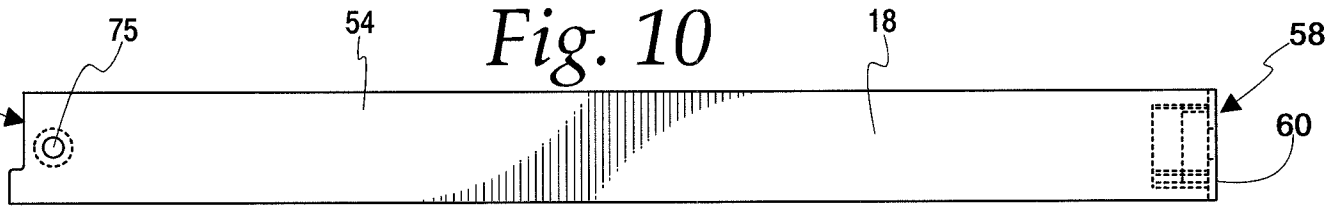
FIG. 10 is a plan view of the closure assembly on the security system.
Figure 11:
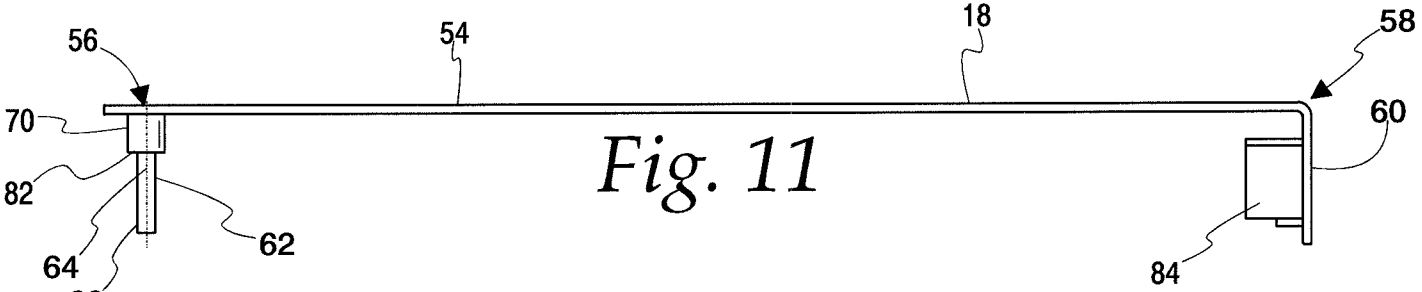
FIG. 11 is a side elevation view of the closure assembly in FIG. 10.
Figure 12:
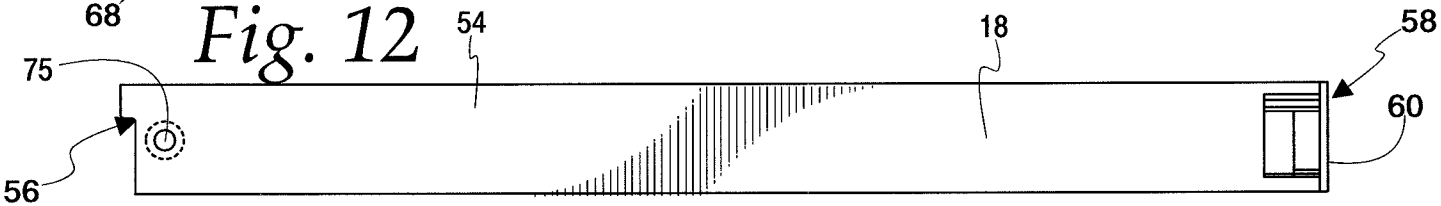
FIG. 12 is a bottom view of the closure assembly in FIGS. 10 and 11.
Figure 13:
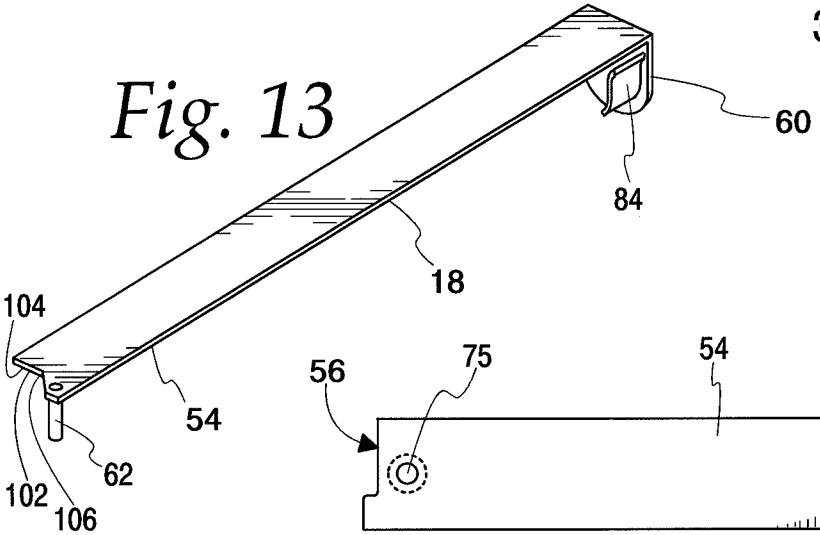
FIG. 13 is a perspective view of the closure assembly in FIGS. 10-12.
Figure 14:
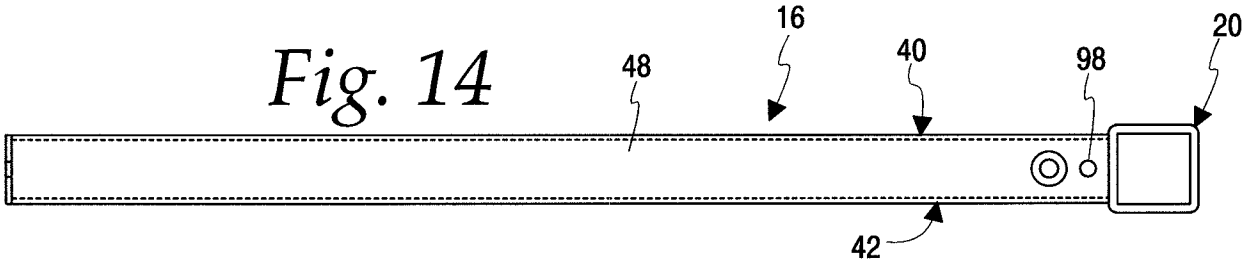
FIG. 14 is a plan view of the frame on the security system with the closure assembly in FIGS. 10-13 removed.
Figure 15:
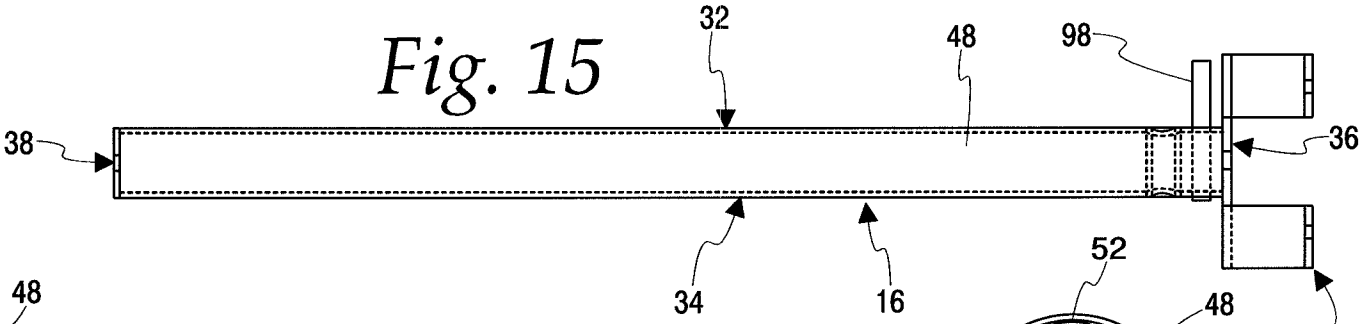
FIG. 15 is a side elevation view of the frame in FIG. 14.

The closure assembly 18 is mounted for guided movement relative to the frame 16 between a loading position, as shown in FIG. 4, and a securing position, as shown in FIGS. 3 and 5-9.

The closure assembly 18 consists of an elongate body 54 in the form of a flat strip with a mounting end 56 and an opposite end 58. As depicted, the end 58 has an offset, depending end portion 60. In the form depicted, the elongate body 54 has a flat shape whereby the elongate strip 54 and offset end portion 60 may be formed from a single sheet of flat stock.

The body 54 is connected to the frame 16 through a stepped diameter post 62 that guides relative pivoting movement between the closure assembly 18 and frame 16 about the post axis 64. The post axis 64 is oriented vertically in this embodiment.

In this embodiment, the post 62 is mounted to the body 48 near the frame end 36. A mounting sleeve 66 vertically spans the diameter of the body 48 and is fixed thereto. A first diameter portion 68 of the post 62 extends into the sleeve 66 and is dimensioned to turn guidingly therewithin about the post axis 64. A larger diameter portion 70 of the post 62 projects upwardly from the first portion 68 and bears downwardly against the top 72 of the mounting sleeve 66 and/or the body 48 and defines a support surface 74 for the mounting end of the body 54, which is fixed thereto. A reduced diameter portion 75 at the free end of the post 62 projects through the body 54 to facilitate rigid connection thereto.

With this arrangement, a gap G is maintained between a downwardly facing surface 76 on the closure assembly 18 and an upwardly facing surface 78 on the frame body 48, with the closure assembly 18 in its securing position. This gap G is continuously encircled cooperatively by the frame 16 and the closure assembly 18 with the security system in its secured state. The gap G is shown to be of substantially uniform dimension over the length of the body 48, though this is not a requirement.

A threaded fastener 80 is secured to the bottom of the post 62 so that the elongate body 48 and the mounting sleeve 66 are captively held between an enlarged head 81 on the fastener 80 and a downwardly facing annular surface 82 on the post 62 at a transition location between the parts 68, 70.

The closure assembly 18 has a wall 84 attached to the offset end portion 60 defining a receptacle 86 into which a part of the elongate body 48, adjacent its end 38, extends as an incident of the closure assembly 18 moving from its loading position into its securing position.

As depicted, the body 48 has a cylindrical outer surface and the receptacle 86 has a concave surface 88 that is complementary to the outer surface shape of the part of the body that nests therein.

Accordingly, with this arrangement, as the security system 14 is changed from its loading state into its securing state, the closure assembly 18 consistently assumes the same securing position as the body 48 moves into the receptacle 88 and its pivoting movement is thereby arrested. This consistently aligns a locking assembly 90 carried on the offset end portion 60 with the end 38 on the elongate body 48. In this embodiment, the locking assembly consists of a cylinder 92 from which an element 94 can be selectively projected into a receptacle 96 on the end 38 of the body 48. With the element 94 extended, the locking assembly 90 is in a locked state, wherein the closure assembly 18 is blocked from pivoting out of its securing position. By retracting the element 94 to the dotted line position, the locking assembly is placed in an unlocked state wherein the closure assembly 18 is free to pivot into and out of the securing position.

To control range of movement for the closure assembly 18, as it is moved from the securing position into the loading position, an additional elongate post 98 is mounted on the frame 16, and in the embodiment shown on the body 48.

The post 98 has a surface 100 that abuts to a surface 102 on the closure assembly 18. The surface 102 is defined by part of an edge 104 on the body 54. In this embodiment, there is a cutout that produces a V-shaped edge surface 106 into which the post 98 nests to positively arrest further pivoting of the body 54.

With the above-described security system 14, the handbags 10, or another type of article that has a U-shaped portion, preferably part of a closed loop shape, can be placed in a display state as follows. Initially, the closure assembly 18 is pivoted about the axis 64 from its securing position into its loading position, as shown in FIG. 4. Pivoting movement is carried out in the direction of the arrow 108. Individual handbags 10 are then serially placed in respective display positions by directing the straps 30 into a straddling relationship with the elongate body 48. Once the desired number of the handbags 10 have been placed in display positions, the closure assembly 18 can be pivoted from the FIG. 4 loading position back into the securing position, whereupon the body 48 abuts to the wall 84, aligning the element 94 with the receptacle 96 in the body 48. The element 94 can then be extended to place the locking assembly 90 in a locked state.

The locking assembly may take many different forms. In one preferred form, the locking assembly 90 is configured so that by simply pressing a button 110, without the need for a key, the element 94 can be advanced to place the locking assembly 90 in the locked state. A key or other type of actuator is required to change the locking assembly 90 back into its unlocked state. This feature makes it simple for those setting up the security system 14 to lock the security system in its secured state and reduces the likelihood that shortcuts will be taken in setting up a display that may make the articles 10 vulnerable to theft.

In one preferred form, the straps 30 are slidable lengthwise along the elongate body 48 with the security system in the secured state. This facilitates separation of the displayed articles to make possible a better complete inspection thereof. The sliding range is dictated by the spacing between the post 70 and offset end portion 60 of the body 54 that depends into vertically overlapping relationship with the body 48 to bound one lengthwise end of the gap G.

It is also contemplated that the straddling portion of an object may be tightly held or compressed between the elongate body 48 and body/strip 54 as the closure assembly 18 is changed from the loading position into the securing position.

It should be understood that the characterization of the frame as having a top and bottom is not limited to a configuration wherein the top and bottom are vertically spaced. Rather, these characterizations provide a frame of reference to define the interaction of the components making up the security system. For example, the security system could be turned through 90° around the axis 50 and would function in substantially the same way. Unless expressly indicated otherwise, the description and claims are intended to encompass a frame with a "top" and "bottom" without limitation as to specific orientation.

The foregoing disclosure of specific embodiments is intended to be illustrative of the broad concepts comprehended by the invention.

The invention claimed is:

1. In combination:

a) a portable consumer article having a U-shaped portion; and b) a security system comprising:

a frame having a top and bottom, a mounting end, an end opposite the mounting end, and laterally spaced sides; and a closure assembly having at least a portion mounted to the frame for guided movement relative to the frame between a loading position, wherein the security system is in a loading state, and a securing position, wherein the security system is in a secured stated, the frame, closure assembly, and portable consumer article configured so that: i) with the security system in the loading state the U-shaped portion and the frame can be relatively moved to cause the opposite end of the frame to be directed through the U-shaped portion whereupon the portable consumer article assumes a display position wherein the U-shaped portion is inverted and straddles a part of the frame between the mounting and opposite frame ends; and ii) with the portable consumer article in the display position and the security system changed from the loading state into the secured state the U-shaped portion is movable between the mounting and opposite ends of the frame while the frame and closure assembly cooperatively prevent the portable consumer article from being separated from the security system by causing the U-shaped portion to be advanced relative to the security system in a direction from the mounting end of the frame towards and past the opposite end of the frame, wherein at least a part of the portion of the closure assembly moves in a generally side-to-side path relative to the frame into overlying relationship with the frame as viewed from the top of the frame as an incident of the portion of the closure assembly moving from the loading position into the securing position, wherein the portion of the closure assembly is pivotable around an axis between the loading and securing positions, wherein there are cooperating surfaces on the frame and the portion of the closure assembly that move up to a facing relationship and against each other as an incident of the portion of the closure assembly pivoting in one direction from the loading position into the securing position to thereby consistently arrest pivoting movement of the portion of the closure assembly in the one direction and thereby block the portion of the closure assembly in a predetermined position relative to the frame with the portion of the closure assembly in the securing position, wherein the frame has a mounting assembly at the mounting end of the frame and an elongate body that projects in cantilever fashion from the mounting assembly, wherein the elongate body has a central axis and a convexly curved surface against which the U-shaped portion of the portable consumer article bears with the portable consumer article in the display position, wherein the cooperating surface on the portion of the closure assembly has a curved shape that defines a receptacle into which a complementarily-shaped part of the elongate body extends as an incident of the portion of the closure assembly moving from the loading position into the securing position, wherein there are additional surfaces on the frame and portion of the closure assembly that abut to limit movement of the portion of the closure assembly as the portion of the closure assembly is pivoted in a direction opposite the one direction.

2. The combination according to claim 1 wherein the frame has an elongate shape between the mounting end of the frame and the opposite end of the frame.

3. The combination according to claim 1 wherein the axis extends in a vertical direction.

4. The combination according to claim 1 wherein the part of the elongate body has a cylindrical outer surface and the cooperating surface defining the receptacle has a concave shape that is complementary to the outer surface of the part of the elongate body.

5. The combination according to claim 1 wherein the additional surface on the frame that abuts the additional surface on the portion of the closure assembly is defined by an elongate post.

6. The combination according to claim 5 wherein the elongate post projects from the elongate body.

7. The combination according to claim 6 wherein the elongate post projects in cantilever fashion from the elongate body.

8. The combination according to claim 1 wherein the portion of the closure assembly comprises an elongate strip with an offset, depending end portion.

9. The combination according to claim 8 wherein the elongate strip has a flat shape.

10. The combination according to claim 8 wherein the elongate strip and offset, depending end portion are formed from a sheet of flat stock.

11. The combination according to claim 9 wherein the flat shape has an edge, wherein the additional surface on the portion of the closure assembly that abuts the additional surface on the frame is on the edge of the flat shape.

12. The combination according to claim 8 wherein the security system further comprises a locking assembly that has locked and unlocked states, the locking assembly in the locked state cooperating between the offset, depending end portion and the opposite end of the frame.

13. The combination according to claim 12 wherein the locking assembly comprises a cylinder with an element that is projected into a receptacle at the opposite end of the frame with the locking assembly in the locked state.

14. The combination according to claim 1 wherein the closure assembly comprises an elongate strip, wherein the elongate strip is supported in spaced relationship with the elongate body along the axis, whereby a vertical gap is maintained between the elongate strip and the elongate body over a majority of the length of the elongate body within which the U-shaped portion of the portable consumer article resides with the portable consumer article in the display position and the security system in the secured state.

15. The combination according to claim 1 wherein the U-shaped portion is part of a closed loop shape.

16. In combination:

a) a portable consumer article having a U-shaped portion that is part of a closed loop shape; and b) a security system comprising:

a frame having a top and bottom, a mounting end, an end opposite the mounting end, and laterally spaced sides, the frame having an elongate body with a length that projects in cantilever fashion from the mounting end; and a closure assembly having at least a portion mounted to the frame for guided movement relative to the frame between a loading position, wherein the security system is in a loading state, and a securing position, wherein the security system is in a secured stated, the frame, closure assembly, and portable consumer article configured so that: i) with the security system in the loading state the U-shaped portion and the frame can be relatively moved to cause the opposite end of the frame to be directed through the closed loop shape whereupon the portable consumer article assumes a display position wherein the U-shaped portion is inverted and straddles a part of the elongate body between the mounting and opposite frame ends; and ii) with the portable consumer article in the display position and the security system changed from the loading state into the secured state the frame and closure assembly cooperatively prevent the portable consumer article from being separated from the security system by causing the U-shaped portion to be advanced relative to the security system in a direction from the mounting end of the frame towards the opposite end of the frame, wherein at least a part of the portion of the closure assembly moves in a generally side-to-side path relative to the frame into overlying relationship with the frame as viewed from the top of the frame as an incident of the portion of the closure assembly moving from the loading position into the securing position, wherein the portion of the closure assembly is pivotable around an axis between the loading and securing positions, wherein there are cooperating surfaces on the frame and the at least part of the portion of the closure assembly that abut to limit movement of the portion of the closure assembly as the portion of the closure assembly is pivoted in one direction from the securing position into the loading position, wherein the at least part of the portion of the closure assembly is elongate with a depending edge portion, wherein there are locking components that cooperate between the depending edge portion and opposite end of the frame that can be releasably placed in a locked state to prevent the portion of the closure assembly from moving out of the securing position, the locking components changeable between the locked state and an unlocked state with the portion of the closure assembly and the elongate body maintained in a same relationship, the portion of the closure assembly movable from the securing position into the loading position with the locking components in the unlocked state, wherein the frame has a mounting assembly at the mounting end of the frame and an elongate body that projects in cantilever fashion from the mounting assembly, wherein the elongate body has a central axis and a convexly curved surface against which the U-shaped portion of the portable consumer article bears with the portable consumer article in the display position, wherein the cooperating surface on the portion of the closure assembly has a curved shape that defines a receptacle into which a complementarily-shaped part of the elongate body extends as an incident of the portion of the closure assembly moving from the loading position into the securing position, wherein there are additional surfaces on the frame and portion of the closure assembly that abut to limit movement of the portion of the closure assembly as the portion of the closure assembly is pivoted in a direction opposite the one direction.

17. The combination according to claim 16 wherein with the closure assembly in the securing position one of the locking components is projected into another of the locking components to change the locking components from the unlocked state into the locked state.

* * * * *